US008632277B2

(12) United States Patent
Taylor

(10) Patent No.: US 8,632,277 B2
(45) **Date of Patent: *Jan. 21, 2014**

(54) RETAINING WALL SOIL REINFORCING CONNECTOR AND METHOD

(75) Inventor: Thomas P. Taylor, Colleyville, TX (US)

(73) Assignee: T & B Structural Systems LLC

( * ) Notice: Subject to any disclaimer, the term of this patent is extended or adjusted under 35 U.S.C. 154(b) by 396 days.

This patent is subject to a terminal disclaimer.

(21) Appl. No.: 12/756,898

(22) Filed: Apr. 8, 2010

(65) Prior Publication Data

US 2010/0247248 A1 Sep. 30, 2010

Related U.S. Application Data

(63) Continuation-in-part of application No. 12/353,615, filed on Jan. 14, 2009, now Pat. No. 7,722,296.

(51) Int. Cl.
*E02D 29/02* (2006.01)

(52) U.S. Cl.
USPC ..... 405/262; 405/284

(58) Field of Classification Search
USPC ..... 405/262, 284, 285, 286
See application file for complete search history.

(56) References Cited

U.S. PATENT DOCUMENTS

| | | | |
|---|---|---|---|
| 991,041 | A | 5/1911 | Toennes |
| RE13,299 | E | 10/1911 | Denison |
| 1,144,143 | A | 6/1915 | McGillivray |
| 1,813,912 | A | 7/1931 | Clark |
| 1,959,816 | A | 5/1934 | Crum |
| 1,992,785 | A | 2/1935 | Steuer |
| 2,137,153 | A | 11/1938 | Brozek |
| 2,208,589 | A | 7/1940 | Leemhuis |
| 2,275,933 | A | 3/1942 | Werner |
| 2,316,712 | A | 4/1943 | Prince |
| 2,327,640 | A | 8/1943 | Hendry |
| 2,552,712 | A | 5/1951 | Ellis |
| 2,703,963 | A | 3/1955 | Gutierrez |
| 2,881,614 | A | 4/1959 | Preininger |
| 3,597,928 | A | 8/1971 | Pilaar |
| 3,680,748 | A | 8/1972 | Brunhuber |

(Continued)

FOREIGN PATENT DOCUMENTS

| | | |
|---|---|---|
| EP | 427221 A | 5/1991 |
| EP | 0679768 | 2/1995 |

(Continued)

OTHER PUBLICATIONS

PCT/US2011/031688 International Search Report and Written Opinion dated Nov. 30, 2011 (10 pages).

(Continued)

*Primary Examiner* — Frederick L Lagman
(74) *Attorney, Agent, or Firm* — Edmonds & Nolte, PC

(57) ABSTRACT

An apparatus and method of connecting an earthen formation to a concrete facing of a mechanically stabilized earth (MSE) structure. A one-piece connector having a stem and a tab, wherein the stem is connected to a soil reinforcing element embedded within the earthen formation and the tab is connected to a facing anchor attached to the concrete facing. The connection allows soil reinforcing mats to swivel in a horizontal plane, but also to shift vertically in reaction to MSE settling or thermal expansion/contraction of an MSE structure.

23 Claims, 6 Drawing Sheets

(56) References Cited

U.S. PATENT DOCUMENTS

| | | | | | |
|---|---|---|---|---|---|
| 3,998,022 | A | | 12/1976 | Muse | |
| 4,075,924 | A | | 2/1978 | McSherry | |
| 4,116,010 | A | * | 9/1978 | Vidal | 405/262 |
| 4,117,686 | A | | 10/1978 | Hilfiker | |
| 4,123,881 | A | | 11/1978 | Muse | |
| 4,134,241 | A | | 1/1979 | Walton | |
| 4,286,895 | A | | 9/1981 | Poli | |
| 4,324,508 | A | | 4/1982 | Hilfiker | |
| 4,329,089 | A | | 5/1982 | Hilfiker | |
| 4,341,491 | A | | 7/1982 | Neumann | |
| 4,343,572 | A | | 8/1982 | Hilfiker | |
| 4,391,557 | A | | 7/1983 | Hilfiker | |
| 4,411,255 | A | | 10/1983 | Lee | |
| 4,470,728 | A | | 9/1984 | Broadbent | |
| 4,505,621 | A | | 3/1985 | Hilfiker | |
| 4,514,113 | A | | 4/1985 | Neumann | |
| 4,616,959 | A | | 10/1986 | Hilfiker | |
| 4,643,618 | A | | 2/1987 | Hilfiker | |
| 4,651,975 | A | | 3/1987 | Howell | |
| 4,653,962 | A | | 3/1987 | McKittrick | |
| 4,661,023 | A | | 4/1987 | Hilfiker | |
| 4,664,552 | A | | 5/1987 | Schaaf | |
| 4,710,062 | A | * | 12/1987 | Vidal et al. | 405/262 |
| 4,725,170 | A | * | 2/1988 | Davis | 405/284 |
| 4,834,584 | A | | 5/1989 | Hilfiker | |
| 4,856,939 | A | | 8/1989 | Hilfiker | |
| 4,914,876 | A | | 4/1990 | Forsberg | |
| 4,920,712 | A | | 5/1990 | Dean, Jr. | |
| 4,929,125 | A | | 5/1990 | Hilfiker | |
| 4,952,098 | A | | 8/1990 | Grayson | |
| 4,961,673 | A | | 10/1990 | Pagano | |
| 4,968,186 | A | | 11/1990 | Ogorchock | |
| 4,993,879 | A | | 2/1991 | Hilfiker | |
| 5,044,833 | A | | 9/1991 | Wilfiker | |
| 5,066,169 | A | | 11/1991 | Gavin | |
| 5,076,735 | A | | 12/1991 | Hilfiker | |
| 5,139,369 | A | | 8/1992 | Jaecklin | |
| 5,156,496 | A | | 10/1992 | Vidal | |
| 5,190,413 | A | | 3/1993 | Carey | |
| 5,207,038 | A | | 5/1993 | Negri | |
| RE34,314 | E | | 7/1993 | Forsberg | |
| 5,257,880 | A | | 11/1993 | Janopaul | |
| 5,259,704 | A | | 11/1993 | Orgorchock | |
| 5,417,523 | A | | 5/1995 | Scales | |
| 5,451,120 | A | | 9/1995 | Martinez-Gonzalez | |
| 5,456,554 | A | | 10/1995 | Barrett | |
| 5,474,405 | A | | 12/1995 | Anderson | |
| D366,191 | S | | 1/1996 | Gay | |
| 5,484,235 | A | | 1/1996 | Hilfiker | |
| 5,487,623 | A | | 1/1996 | Anderson | |
| 5,494,379 | A | | 2/1996 | Anderson | |
| 5,507,599 | A | | 4/1996 | Anderson | |
| 5,522,682 | A | | 6/1996 | Egan | |
| 5,525,014 | A | * | 6/1996 | Brown | 405/262 |
| 5,531,547 | A | | 7/1996 | Shimada | |
| 5,533,839 | A | | 7/1996 | Shimada | |
| 5,582,492 | A | | 12/1996 | Doyle | |
| 5,622,455 | A | | 4/1997 | Anderson | |
| 5,702,208 | A | | 12/1997 | Hilfiker | |
| 5,722,799 | A | | 3/1998 | Hilfiker | |
| 5,730,559 | A | | 3/1998 | Anderson | |
| 5,733,072 | A | | 3/1998 | Hilfiker | |
| D393,989 | S | | 5/1998 | Groves | |
| 5,749,680 | A | | 5/1998 | Hilfiker | |
| 5,797,706 | A | | 8/1998 | Segrestin | |
| 5,807,030 | A | | 9/1998 | Anderson | |
| 5,820,305 | A | | 10/1998 | Taylor | |
| 5,947,643 | A | | 9/1999 | Anderson | |
| 5,951,209 | A | | 9/1999 | Anderson | |
| 5,971,699 | A | | 10/1999 | Winski | |
| 5,975,809 | A | | 11/1999 | Taylor | |
| 5,975,810 | A | | 11/1999 | Taylor | |
| 6,024,516 | A | | 2/2000 | Taylor | |
| 6,050,748 | A | * | 4/2000 | Anderson et al. | 405/262 |
| 6,079,908 | A | | 6/2000 | Anderson | |
| 6,086,288 | A | | 7/2000 | Ruel | |
| D433,291 | S | | 11/2000 | Shamoon | |
| 6,186,703 | B1 | | 2/2001 | Shaw | |
| 6,336,773 | B1 | | 1/2002 | Anderson | |
| 6,345,934 | B1 | | 2/2002 | Jailoux | |
| 6,357,970 | B1 | | 3/2002 | Hilfiker | |
| 6,517,293 | B2 | | 2/2003 | Taylor | |
| 6,595,726 | B1 | | 7/2003 | Egan | |
| 6,793,436 | B1 | | 9/2004 | Ruel et al. | |
| 6,802,675 | B2 | * | 10/2004 | Timmons et al. | 405/284 |
| 6,857,823 | B1 | | 2/2005 | Hilfiker | |
| 6,939,087 | B2 | | 9/2005 | Ruel | |
| 7,033,118 | B2 | | 4/2006 | Hilfiker | |
| 7,073,983 | B2 | | 7/2006 | Hilfiker | |
| 7,270,502 | B2 | | 9/2007 | Brown | |
| 7,281,882 | B2 | | 10/2007 | Hilfiker | |
| 7,399,144 | B2 | | 7/2008 | Kallen | |
| D599,630 | S | | 9/2009 | Taylor | |
| 7,722,296 | B1 | * | 5/2010 | Taylor | 405/262 |
| 7,891,912 | B2 | | 2/2011 | Taylor | |
| 7,972,086 | B2 | | 7/2011 | Taylor | |
| 7,980,790 | B2 | | 7/2011 | Taylor | |
| 8,079,782 | B1 | | 12/2011 | Hilfiker | |
| 2002/0044840 | A1 | | 4/2002 | Taylor et al. | |
| 2002/0067959 | A1 | | 6/2002 | Thornton | |
| 2003/0223825 | A1 | | 12/2003 | Timmons | |
| 2004/0018061 | A1 | | 1/2004 | Jansson | |
| 2004/0161306 | A1 | | 8/2004 | Ruel | |
| 2004/0179902 | A1 | | 9/2004 | Ruel | |
| 2005/0111921 | A1 | | 5/2005 | Taylor | |
| 2005/0163574 | A1 | | 7/2005 | Hilfiker | |
| 2005/0271478 | A1 | | 12/2005 | Ferraiolo | |
| 2005/0286981 | A1 | | 12/2005 | Robertson | |
| 2006/0204342 | A1 | | 9/2006 | Hilfiker | |
| 2006/0239783 | A1 | | 10/2006 | Kallen | |
| 2007/0014638 | A1 | * | 1/2007 | Brown | 405/262 |
| 2009/0016825 | A1 | | 1/2009 | Taylor | |
| 2009/0067933 | A1 | | 3/2009 | Taylor | |
| 2009/0285639 | A1 | | 11/2009 | Taylor | |
| 2009/0304456 | A1 | | 12/2009 | Taylor | |
| 2010/0247248 | A1 | | 9/2010 | Taylor | |
| 2011/0170957 | A1 | | 7/2011 | Taylor | |
| 2011/0170958 | A1 | | 7/2011 | Taylor | |
| 2011/0170960 | A1 | | 7/2011 | Taylor | |
| 2011/0229274 | A1 | | 9/2011 | Taylor | |
| 2011/0311317 | A1 | | 12/2011 | Taylor | |
| 2011/0311318 | A1 | | 12/2011 | Taylor | |

FOREIGN PATENT DOCUMENTS

| | | | |
|---|---|---|---|
| FR | 530097 | | 9/1921 |
| FR | 1006087 | | 1/1952 |
| JP | 3114014 | | 6/1991 |
| JP | 8209703 | A | 8/1996 |
| JP | 8326074 | A | 12/1996 |
| KR | 1020080058697 | | 6/2008 |
| KR | 1020100027693 | | 3/2010 |
| WO | WO9413890 | | 6/1994 |
| WO | WO2009009369 | | 1/2009 |
| WO | WO2009140576 | | 11/2009 |
| WO | WO2010082940 | | 7/2010 |
| WO | WO2011084983 | | 7/2011 |
| WO | WO2011084986 | | 7/2011 |
| WO | WO2011084989 | | 7/2011 |
| WO | 2011127349 | A2 | 10/2011 |
| WO | WO2011059807 | | 12/2011 |
| WO | WO2011159808 | | 12/2011 |

OTHER PUBLICATIONS

International Application No. PCT/US08/69011—International Search Report and Written Opinion dated Oct. 10, 2008.

International Application No. PCT/US09/031494—International Search Report and Written Opinion dated Mar. 13, 2009.

International Application No. PCT/US09/44099—International Search Report and Written Opinion dated Aug. 12, 2009.

International Application No. PCT/US08/069011—International Preliminary Report on Patentability dated Jan. 21, 2010.

(56) References Cited

OTHER PUBLICATIONS

International Application No. PCT/US10/036991—International Search Report and Written Opinion dated Aug. 2, 2010.
International Application No. PCT/US09/44099—International Preliminary Report on Patentability dated Nov. 25, 2010.
International Application No. PCT/US2010/036991—International Preliminary Examination Reported mailed Jul. 14, 2011.
International Application No. PCT/US09/0031494—International Preliminary Report on Patentability dated Jul. 19, 2011.
International Application No. PCT/US2010/036991—Corrected International Preliminary Examination Report mailed Aug. 15, 2011.
International Application No. PCT/US2011/040540—International Search Report and Written Opinion dated Feb. 17, 2012.
International Application No. PCT/US2011/040543—International Search Report and Written Opinion dated Feb. 21, 2012.
International Application No. PCT/US2011/040541—International Search Report and Written Opinion dated Feb. 27, 2012.
Webster's tenth edition, "Collegiate Dictionary", p. 423; 1998.

* cited by examiner

RETAINING WALL SOIL REINFORCING CONNECTOR AND METHOD

The present application claims priority to U.S. Utility patent application Ser. No. 12/353,615, entitled "Retaining Wall Soil Reinforcing Connector and Method," which was filed on Jan. 14, 2009, the contents of which are incorporated by reference in its entirety.

BACKGROUND OF THE DISCLOSURE

Retaining wall structures that use horizontally positioned soil inclusions to reinforce an earth mass in combination with a facing element are referred to as mechanically stabilized earth (MSE) structures. MSE structures can be used for various applications including retaining walls, bridge abutments, dams, seawalls, and dikes.

The basic MSE technology is a repetitive process where layers of backfill and horizontally-placed soil reinforcing elements are positioned one atop the other until a desired height of the earthen structure is achieved. Typically, grid-like steel mats or welded wire mesh are used as soil reinforcing elements. In most applications, the soil reinforcing elements consist of parallel, transversely-extending wires welded to parallel, longitudinally-extending wires, thus forming a grid-like mat or structure. Backfill material and the soil reinforcing mats are combined and compacted in series to form a solid earthen structure, taking the form of a standing earthen wall.

In some instances, a substantially vertical wall, typically made of concrete or steel facing panels, may be constructed a short distance from the standing earthen wall, or constructed simultaneously as the earthen wall rises upward. The vertical wall not only serves as decorative architecture, but also prevents erosion of the earthen wall. The soil reinforcing mats extending from the compacted backfill may be attached directly to the back face of the vertical wall in a variety of configurations. To facilitate this connection, the vertical wall will frequently include a plurality of facing anchors either cast into or attached somehow to the back face of the wall at predetermined and/or spaced-apart locations. Each facing anchor is typically positioned so as to correspond with and couple directly to the end of a soil reinforcing mat. Via this attachment, outward movement and shifting of the vertical wall is significantly reduced.

Although there are several methods of attaching soil reinforcing elements to facing structures, it nonetheless remains desirable to find improved facing anchors and soil reinforcing mat connectors offering less expensive alternatives and greater resistance to shear forces inherent in such structures.

SUMMARY OF THE DISCLOSURE

Embodiments of the disclosure may provide a system for securing a facing to an earthen formation. The system may include a soil reinforcing element having a pair of longitudinal wires welded to a plurality of spaced transverse wires, wherein the pair of longitudinal wires have lead ends that converge toward one another. The system may further include a connection stud having a first end coupled to the lead ends of the longitudinal wires and a second end defining one or more holes centrally-disposed therethrough, and a facing anchor having first and second connection points extending from a back face of the facing and vertically-offset from each other a distance X, each connection point defining a horizontally-disposed perforation. The system may also include a coupling device configured to be coupled simultaneously to the horizontally-disposed perforation of each connection point and the hole of the connection stud to thereby secure the connection stud to the facing anchor. When connected, the soil reinforcing element is capable of swiveling in a horizontal plane and shifting vertically over the distance X.

Another exemplary embodiment of the disclosure may provide a method of securing a facing to a soil reinforcing element. The method may include welding a pair of converging lead ends of the soil reinforcing element to a first end of a connection stud, and inserting a second end of the connection stud into a gap formed between first and second connection points of a facing anchor, the second end and first and second connection points each defining a horizontally-disposed perforation therein, wherein the first and second connection points extend from a back face of the facing and are vertically-offset a distance X. The method may further include securing the connection stud against separation from the facing anchor by inserting a coupling device simultaneously into the horizontally-disposed perforations of each of the second end and first and second connection points. Once connected, the soil reinforcing element is capable of swiveling in a horizontal plane and shifting vertically over the distance X.

Another exemplary embodiment of the disclosure may provide a connection stud for securing a soil reinforcing element to a facing. The connection stud may include a stem having a first end and a second end, the second end of the stem being coupled to a pair of converging longitudinal wires from the soil reinforcing element. The connection stud may also include a tab coupled to the first end of the stem and defining at least one hole within the tab, wherein the tab is configured to be secured via the at least one hole to a facing anchor extending from a back face of the facing. Once connected, the soil reinforcing element may be capable of swiveling about an axis defined through the at least one hole in a horizontal plane and shifting vertically over a distance X.

DETAILED DESCRIPTION

Figure 1A:
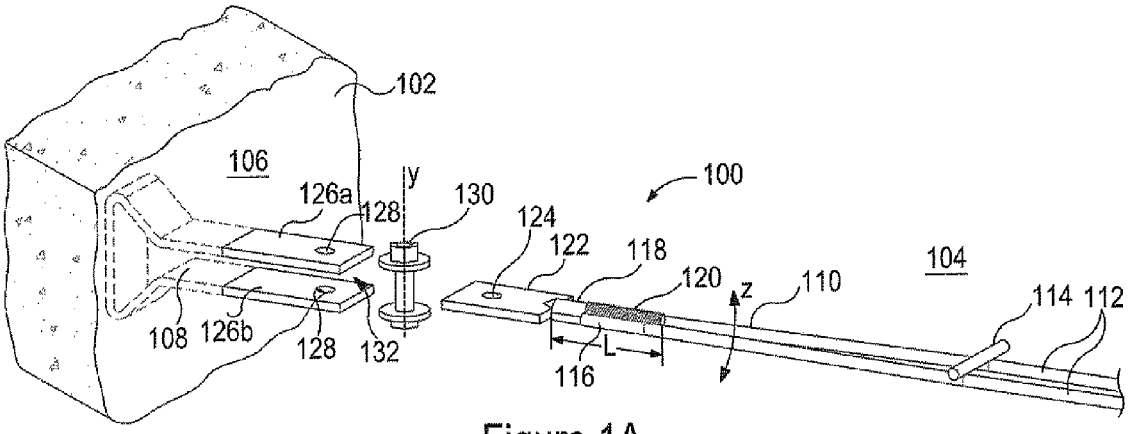
FIG. 1A is an exploded perspective view of a soil reinforcing system, according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

The present disclosure may be embodied as an improved apparatus and method of connecting an earthen formation to a concrete facing of a mechanically stabilized earth (MSE) structure. In particular, disclosed is a low-cost, one-piece MSE connector, and variations of the same, that allows soil reinforcing mats to swivel in order to avoid vertically-disposed obstructions, such as drainage pipes, catch basins, bridge piles, or bridge piers, which may be encountered in the backfill field. The MSE connector may also allow soil reinforcing mats to shift vertically in reaction to MSE settling or thermal expansion/contraction of an MSE structure. The ability of the soil reinforcing element to shift and swivel provides a distinct advantage in that the structural integrity of the MSE system is not jeopardized over time, but that it may move in response to natural occurrences.

Figure 1B:
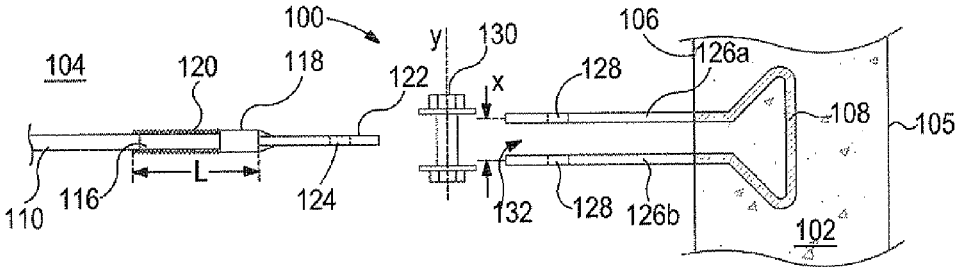
FIG. 1B is a side view of the system shown in FIG. 1A.
Figure 1C:
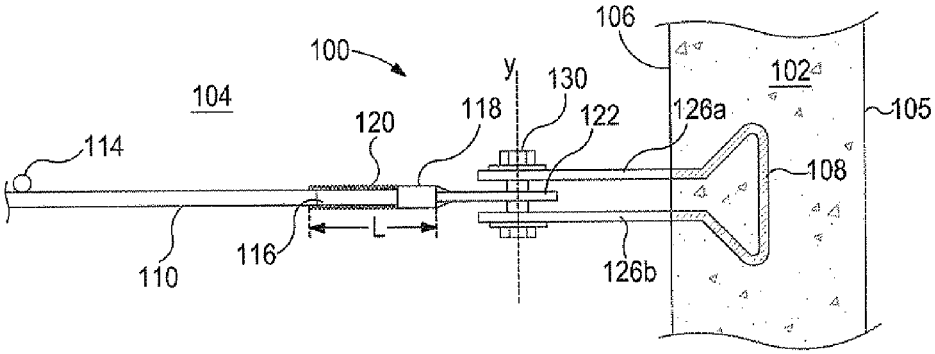
FIG. 1C is a side view of the system shown in FIG. 1A coupled together, according to one or more aspects of the present disclosure.

Referring to FIGS. 1A-1C, illustrated is an exemplary system 100 for securing a facing 102 to an earthen formation or backfill 104 mass, according to one or more aspects of the disclosure. The facing 102 may include an individual precast concrete panel or, alternatively, a plurality of interlocking precast concrete modules or wall members that are assembled into an interlocking relationship. In another embodiment, the facing 102 may be a uniform, unbroken expanse of concrete or the like which may be poured or assembled on site. The facing 102 may generally define an exposed face 105 (FIGS. 1B and 1C) and a back face 106. The exposed face 105 typically includes a decorative architectural facing, while the back face 106 is located adjacent the backfill 104. Cast into the facing 102, or otherwise attached thereto, and protruding generally from the back face 106, is at least one exemplary facing anchor 108. Instead of being cast into the facing 102, the facing anchor 108 may be mechanically fastened to the back face 106, for example, using bolts (not shown). As will be described below, several variations of the facing anchor 108 may be implemented without departing from the scope of the disclosure.

The earthen formation or backfill 104 may encompass an MSE structure including a plurality of soil reinforcing elements 110 that extend horizontally into the backfill 104 to add tensile capacity thereto. In an exemplary embodiment, the soil reinforcing elements 110 may serve as tensile resisting elements positioned in the backfill 104 in a substantially horizontal alignment at spaced-apart relationships to one another against the compacted soil. Depending on the application, grid-like steel mats or welded wire mesh may be used as soil reinforcement elements 110, but it is not uncommon to employ "geogrids" made of plastic or other materials to accomplish the same end.

In the illustrated exemplary embodiment, the soil reinforcing element 110 may include a welded wire grid having a pair of longitudinal wires 112 that are substantially parallel to each other. The longitudinal wires 112 may be joined to a plurality of transverse wires 114 in a generally perpendicular fashion by welds at their intersections, thus forming a welded wire gridworks. In exemplary embodiments, the spacing between each longitudinal wire 112 may be about 2 in., while spacing between each transverse wire 114 may be about 6 in. As can be appreciated, however, the spacing and configuration may vary depending on the mixture of tensile force requirements that the reinforcing element 110 must resist.

In one or more embodiments, lead ends 116 of the longitudinal wires 112 may generally converge toward one another and be welded or otherwise attached to a connection stud 118. The connection stud 118 may include a first end or a stem 120 coupled or otherwise attached to a second end or a tab 122. As will be described below, several variations of the connection stud 118 may be implemented, without departing from the disclosure. In at least one embodiment, the stem 120 may include a cylindrical body having an axial length L. As illustrated, the lead ends 116 may be coupled or otherwise attached to the stem 120 along at least a portion of the axial length L. In one embodiment, the tab 122 may be a substantially planar plate and define at least one centrally-located perforation or hole 124.

In at least one embodiment, the facing anchor 108 may include a pair of horizontally-disposed connection points or plates 126*a*, 126*b* cast into and extending from the back face 106 of the panel 102. As can be appreciated, other embodiments include attaching the facing anchor directly to the back face 106, without departing from the disclosure. Furthermore, as can be appreciated, other embodiments of the disclosure contemplate a facing anchor 108 having a single horizontal plate 126 (not shown), where the tab 122 is coupled only to the single plate 126 via appropriate coupling devices.

Each plate 126*a,b* may include at least one perforation 128 adapted to align with a corresponding perforation 128 on the opposing plate 126*a,b*. As illustrated in FIG. 1B, the plates 126,*b* may be vertically-offset a distance X, thereby generating a gap 132 configured to receive the tab 122 for connection to the anchor 108. In operation, the tab 122 may be inserted into the gap 132 until the hole 124 aligns substantially with the perforations 128 of each plate 126*a,b*. A coupling device, such as a nut and bolt assembly 130 or the like, may then be used to secure the connection stud 118 (and thus the soil reinforcing element 110) to the facing anchor 108. In one or more embodiments, the nut and bolt assembly 130 may include a threaded bolt having a nut and washer assembly, but can also include a pin-type connection having an end that prevents it from removal, such as a bent-over portion.

In this arrangement, the soil reinforcing element 110 (as coupled to the connection stud 118) may be allowed to swivel or rotate about axis Y in a horizontal plane Z (FIG. 1A). Rotation about axis Y may prove advantageous since it allows the system 100 to be employed in locations where a vertical obstruction, such as a drainage pipe, catch basin, bridge pile, bridge pier, or the like may be encountered in the backfill 104. To avoid such obstructions, the soil reinforcing element 110 may be pivoted about axis Y to any angle relative to the back face 106, thereby swiveling to a position where no obstacle exists.

Moreover, the gap 132 defined between two vertically-offset plates 126*a,b* may also prove significantly advantageous. For example, the gap 132 may compensate or allow for the settling of the MSE structure as the soil reinforcing element 110 settles in the backfill 104. During settling, the tab 122 may be able to shift or slide vertically about the nut and bolt assembly 130 the distance X, thereby compensating for a potential vertical drop of the soil reinforcing element 110 and preventing any buckling of the concrete facing 102. As will be appreciated by those skilled in the art, varying designs of anchors 108 may be used that increase or decrease the distance X to compensate for potential settling or other MSE mechanical phenomena.

Furthermore, it is not uncommon for concrete facings 102 to shift in reaction to MSE settling or thermal expansion/contraction. In instances where such movement occurs, the soil reinforcing elements 110 of the disclosure are capable of correspondingly swiveling about axis Y and shifting the vertical distance X to prevent misalignment, buckling, or damage to the concrete facing 102.

Figure 2A:
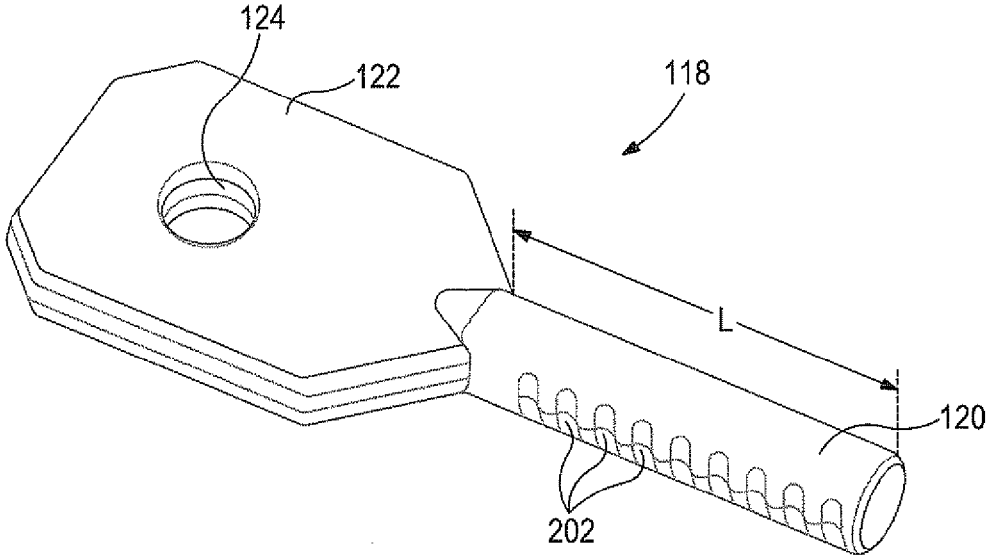
FIG. 2A is an isometric view of a connection stud, according to one or more aspects of the present disclosure.
Figure 2B:
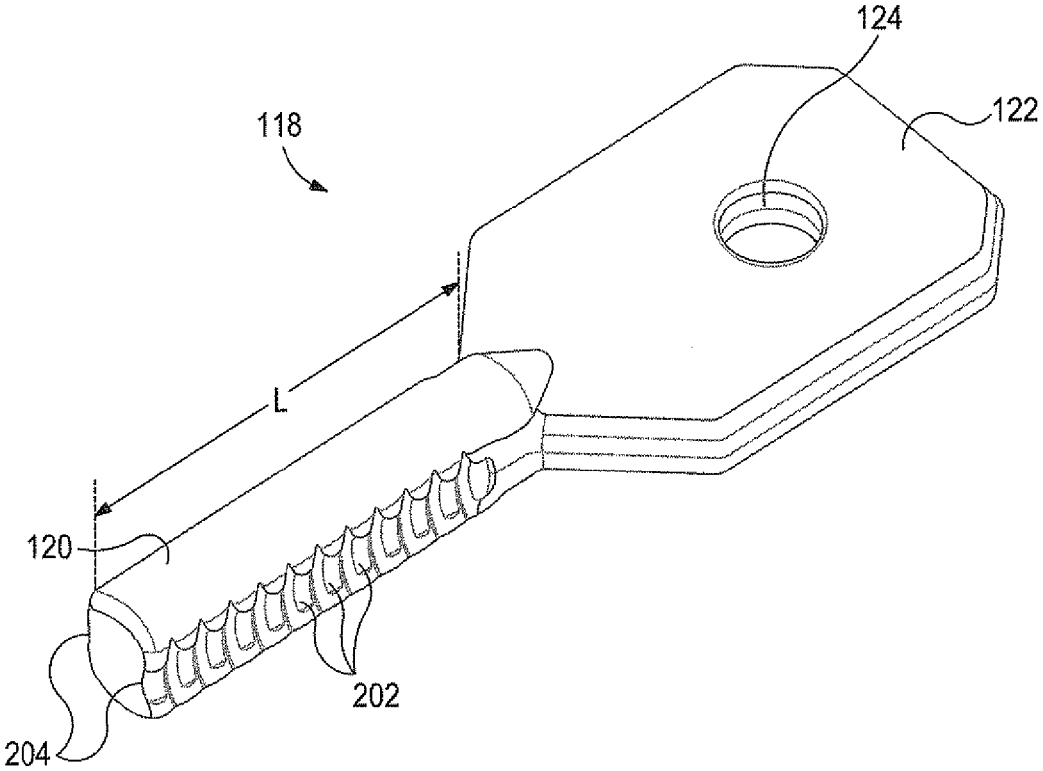
FIG. 2B is an isometric view of another connection stud, according to one or more aspects of the present disclosure.

Referring now to FIGS. 2A and 2B, illustrated is one or more exemplary embodiments of the connection stud 118. In one embodiment, the connection stud 118 can be created from a one-piece forging process. In other embodiments, however, the connection stud 118 can be created by welding or otherwise attaching the stem 120 to the tab 122. As illustrated, the stem 120 may include a plurality of indentations or grooves 202 defined along its axial length L. In one embodiment, the grooves 202 may be cast or otherwise machined into the stem 120. In other embodiments, the grooves 202 can include standard thread markings machined along the axial length L of the stem 120. As can be appreciated, the grooves 202 may provide a more suitable welding surface for attaching the lead ends 116 of the longitudinal wires 112 (FIGS. 1A-1C) thereto, thereby resulting in a stronger resistance weld.

As illustrated in FIG. 2B, the stem 120 may include an axial channel 204 extending along the axial length L on opposing sides. In at least one embodiment, the axial channels 204 may be formed during a casting or forging process. In other embodiments, however, the axial channels 204 may be generated by applying longitudinal pressure to the opposing sides of the stem 120 with a cylindrical die or the like (not shown). The axial channels 204 may include the grooves 202 machined or otherwise formed therein. The grooves 202 may be generated during the forging process, or via the cylindrical die that forms the axial channels 204. In other embodiments, however, the grooves 202 may be subsequently machined into the axial channels 204 after a forging process and/or the application of a cylindrical die. As can be appreciated, the axial channels 204 may provide an added amount arcuate surface area to weld the lead ends 116 of the longitudinal wires 112 to, thereby creating a more solid resistance weld. Moreover, because of the added amount of arcuate surface area, the axial channels 204 may serve to protect the resistance weld from corrosion over time.

Figure 3A:
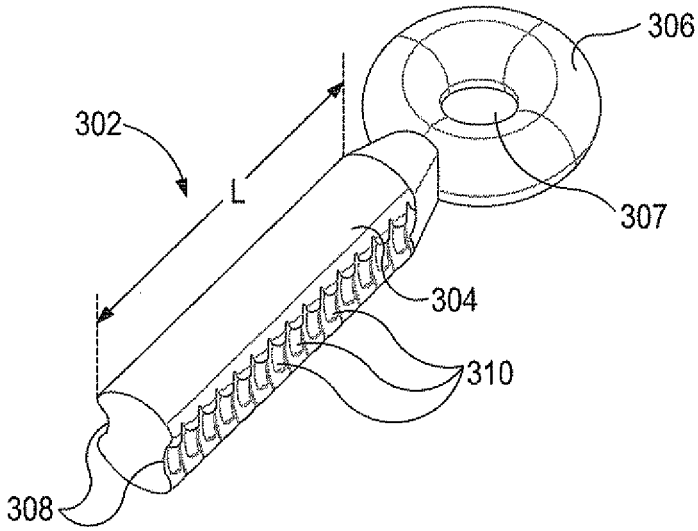
FIG. 3A is an isometric view of an exemplary loop-type connection stud, according to one or more aspects of the present disclosure.
Figure 3B:
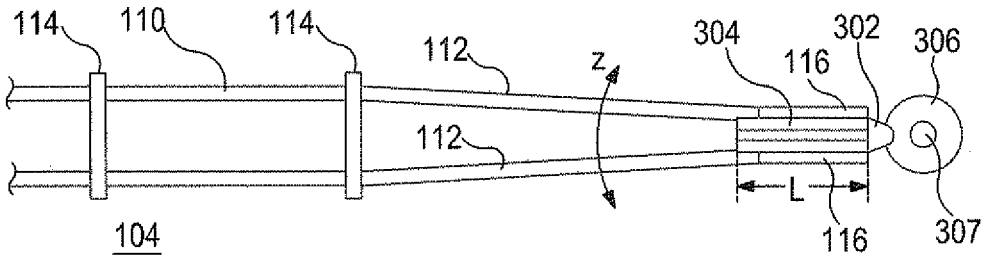
FIG. 3B is a plan view of a soil reinforcing element coupled to the loop-type connection stud of FIG. 3A, according to one or more aspects of the present disclosure.
Figure 3C:
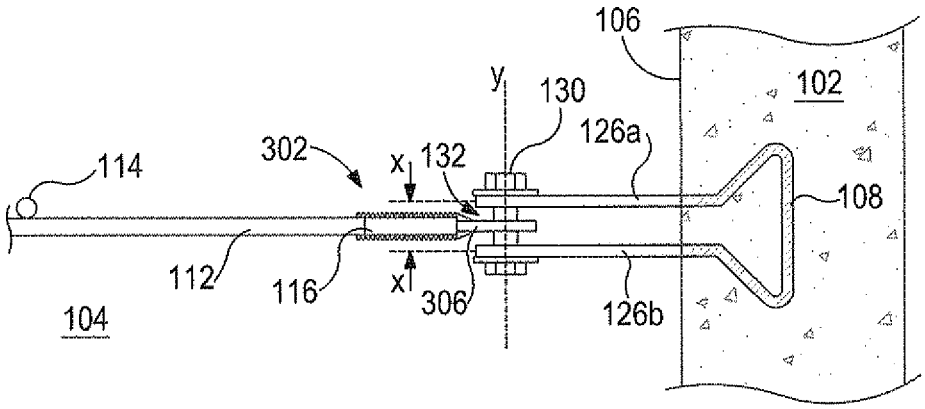
FIG. 3C is a side view of the soil reinforcing element and loop-type connection stud of FIG. 3B coupled to a facing anchor, according to one or more aspects of the present disclosure.

Referring now to FIGS. 3A-3C, depicted is another exemplary embodiment of the connection stud 118, specifically, a loop-type connection stud 302. Similar to the previously-described connection stud 118, the loop-type connection stud 302 can include a first end or stem 304 coupled to a second end or tab 306. As illustrated, however, the tab 306 may be a loop or ring that defines a perforation or hole 307 for connecting the loop-type connection stud 302 to a facing anchor 108, as will be described below. Also similar to the previously-described connection stud 118, the loop-type connection stud 302 can be created in a one-piece forging process or, alternatively, the stem 304 can be welded or otherwise attached to the tab 306. In other embodiments, the loop-type connection stud 302 may be formed from a single length of continuous wire bent to form the loop of the tab 306 and welded thereto, while the remaining portion of wire forms the stem 304.

As best illustrated in FIG. 3A, the stem 304 can define axial channels 308 disposed along opposing sides of its axial length L. Moreover, the stem 304 can include a plurality of grooves 310 cast in or otherwise machined along its length L within the axial channels 308 to provide a more suitable welding surface for the lead ends 116 of the longitudinal wires 112 (FIG. 3B). As can be appreciated, however, other embodiments contemplate a stem 304 similar to the stem 120 depicted in FIG. 2A, wherein the stem 304 includes a straight cylindrical shaft devoid of any axial channels 308, but nonetheless defining grooves 310 along its axial length L.

FIG. 3C illustrates the loop-type connection stud 302 coupled to the exemplary facing anchor 108 as generally described with reference to FIGS. 1A-1C above. In operation, the tab 306 may be inserted into the gap 132 defined between each plate 126*a*, 126*b* extending horizontally from the back face 106 of the panel 102. Once the hole 307 of the tab 306 substantially aligns with the perforations 128 (FIG. 1A) of each plate 126*a,b*, a coupling device, or such as a bolt assembly 130 or the like, may again be used to secure the loop-type connection stud 302 (and thus the soil reinforcing element 110) to the facing anchor 108. Once secured to the anchor 108, the loop-type connection stud 302 may be free to swivel or rotate about axis Y in a horizontal plane Z (FIG. 3B), and move vertically up and down the nut and bolt assembly 130 for the distance X. Again, varying designs of anchors 108 may be used that increase or decrease the distance X to compensate for potential settling of the backfill 104 or other MSE mechanical/natural phenomena.

Figure 4A:
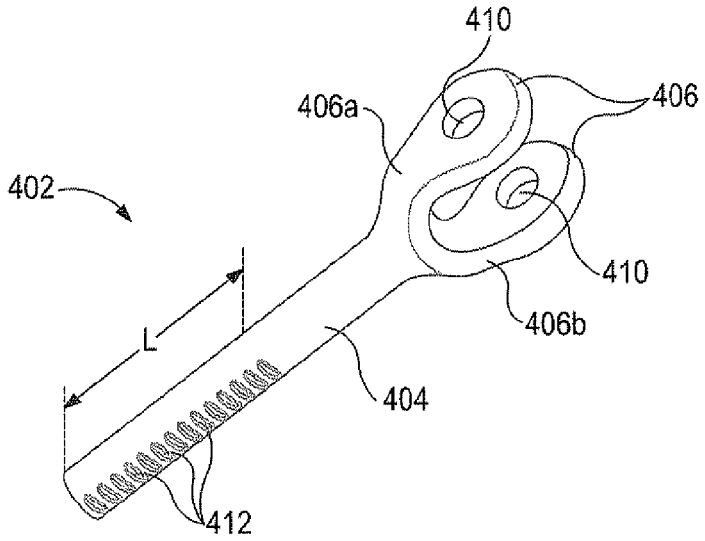
FIG. 4A is an isometric view of an exemplary dual-prong connection stud, according to one or more aspects of the present disclosure.
Figure 4B:
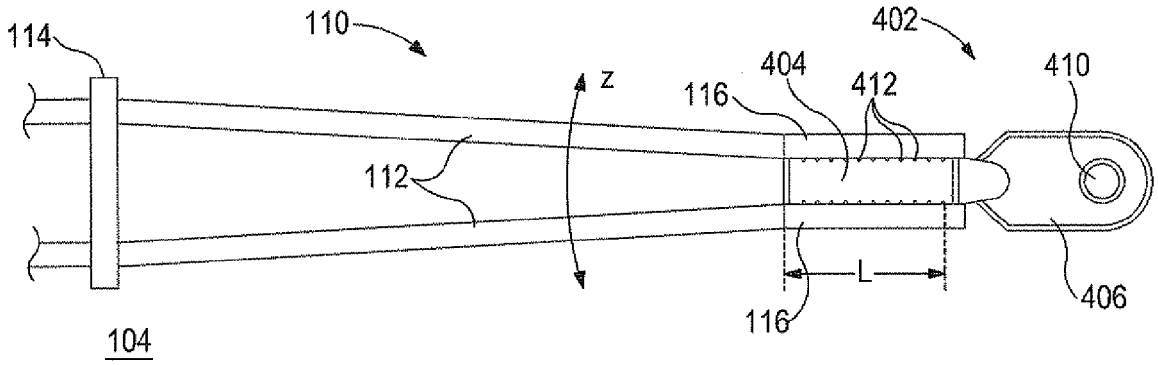
FIG. 4B is a plan view of a soil reinforcing element coupled to the dual-prong connection stud of FIG. 4A, according to one or more aspects of the present disclosure.
Figure 4C:
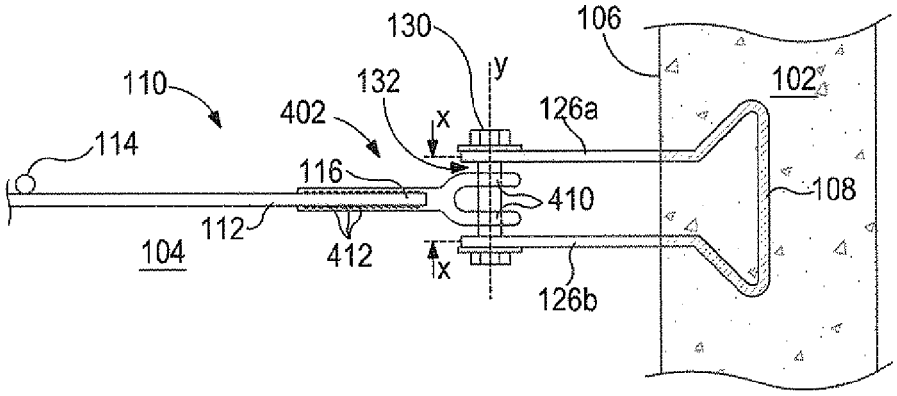
FIG. 4C is a side view of the soil reinforcing element and dual-prong connection stud of FIG. 4B coupled to a facing anchor, according to one or more aspects of the present disclosure.

Referring now to FIGS. 4A-4C, depicted is another exemplary embodiment of a connection stud 118, specifically, a dual-prong connection stud 402. Similar to the previously-described connection stud 118, the dual-prong connection stud 402 can include a first end or stem 404 coupled to a second end or tab 406. As illustrated, the tab 406 may include a pair of prongs 406*a*, 406*b* vertically offset from each other and extending axially from the stem 404. Each prong 406*a,b* may define a centrally-disposed perforation or hole 410 used for connecting the dual-prong connection stud 402 to an exemplary facing anchor 108 (FIG. 4C), as will be described below. Each hole 410 may be coaxially aligned with the opposing hole. The dual-prong connection stud 402 can be created via a one-piece forging process or, alternatively, the stem 404 can be welded or otherwise attached to the tab 406 via processes known to those skilled in the art.

As illustrated, the stem 402 may include a plurality of indentations or grooves 412 defined, cast, or otherwise machined along its axial length L. In at least one embodiment, the grooves 412 can include standard thread markings machined along the axial length L. In other embodiments, the stem 402 may include axial channels (not shown) having grooves 412 similar to the axial channels 204, 308 shown and described in FIGS. 2B, 3A, respectively. Once again, the grooves 412 may provide a more solid resistance weld surface for attaching the lead ends 116 of the longitudinal wires 112 (FIG. 4C) thereto.

FIG. 4C illustrates the dual-prong connection stud 402 coupled to the exemplary facing anchor 108 as generally described with reference to FIGS. 1A-1C above. In operation, the prongs 406*a,b* of the tab 406 may be inserted into the gap 132 defined between each plate 126*a*, 126*b* extending horizontally from the back face 106 of the panel 102. Once the holes 410 are substantially aligned with the perforations 128 (FIG. 1A) of each plate 126*a,b*, a coupling device, such as the nut and bolt assembly 130, may again be used to secure the dual-prong connection stud 402 (and thus the soil reinforcing element 110) to the facing anchor 108. As with previously-described embodiments, once secured to the facing anchor 108, the dual-prong connection stud 402 may be free to swivel or rotate about axis Y in horizontal plane Z, and move vertically up and down the nut and bolt assembly 130 for the distance X. Again, alterations in the design of the anchor 108 may be used to increase or decrease the distance X to compensate for potential backfill 104 settling or other MSE mechanical/natural phenomena.

In other embodiments, the facing anchor 108 may include a single horizontal plate 126 extending from the back face 106, and the tab 406 may be appropriately coupled thereto by positioning the upper and lower prongs 406*a,b* above and below the single plate 126. In such an embodiment, the distance X may be defined between the two prongs 406*a,b*, thereby continuing to allow the soil reinforcing element 110 to vertically translate the distance X in response to MSE settling or expansion/contraction. As can be appreciated, alterations to the design of the connection stud 402 may be undertaken to increase the distance X defined between upper and lower prongs 406*a,b*, and thereby provide the soil reinforcing element 110 more vertical distance to translate.

Figure 5A:
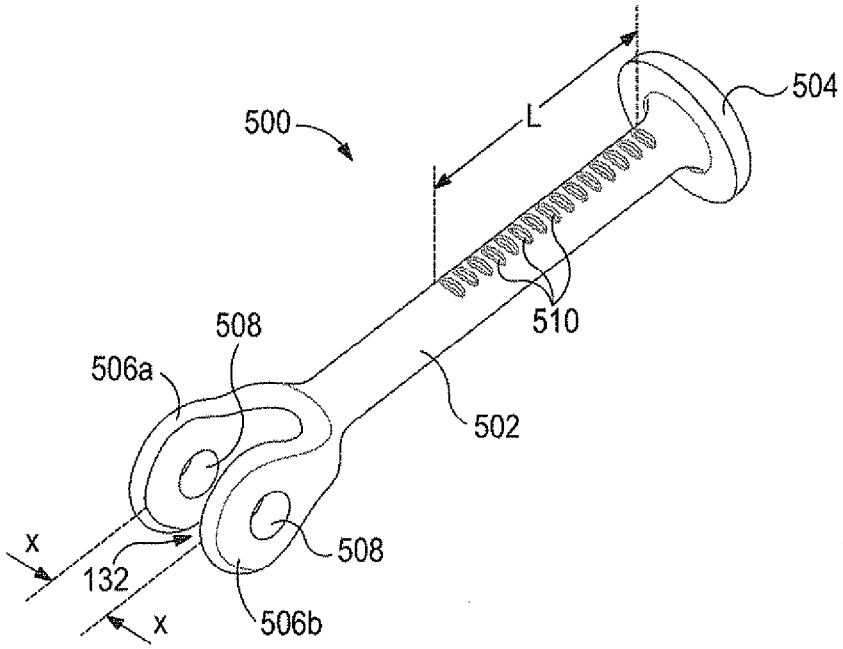
FIG. 5A is a perspective view of an exemplary dual-prong facing anchor, according to one or more aspects of the present disclosure.
Figure 5B:
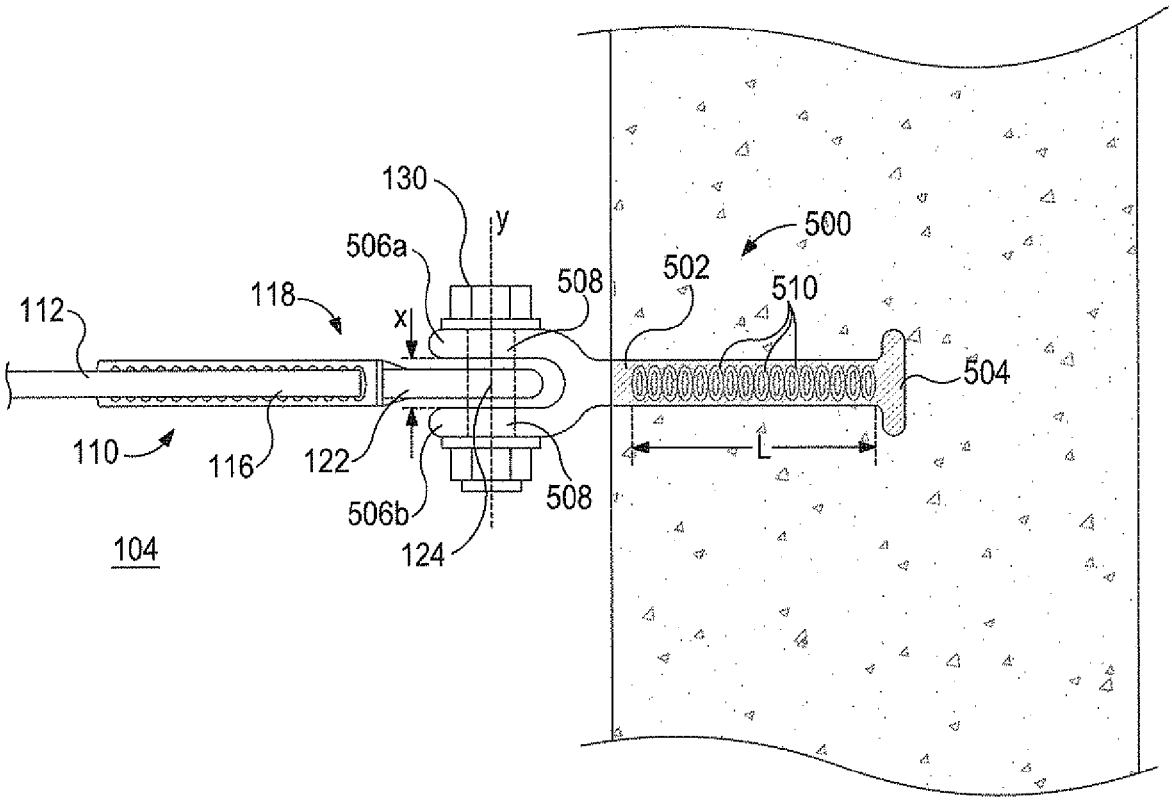
FIG. 5B is a side view of the dual-prong facing anchor of FIG. 5A connected to a connection stud, according to one or more aspects of the present disclosure.

Referring now to FIGS. 5A and 5B, illustrated is another exemplary facing anchor 108, specifically, a dual-prong stud anchor 500, according to an embodiment of the disclosure. As illustrated, the stud anchor 500 may include an elongated shaft 502 having a head 504 disposed at one end and a pair of vertically-offset connection points or prongs 506*a*, 506*b* extending axially from the other end of the elongated shaft 502. Each prong 506*a,b* may define a centrally-disposed perforation or hole 508 and may be vertically-offset by a distance X, thereby creating a gap 132 therebetween. As will be described more fully below, the gap 132 allows a connection stud 118 (FIGS. 2A and 2B), 302 (FIG. 3A), 402 (FIG. 4A) to be inserted therein for coupling a soil reinforcing element 110 to the facing anchor 500.

As depicted in FIG. 5B, the facing anchor 500 may be disposed within a facing 102, having a portion of the shaft 502 and the pair of prongs 506*a,b* protruding horizontally from the back face 106 of the facing 102 and into the backfill 104. In one embodiment, a plurality of facing anchors 500 may be cast directly into the facing 102 at predetermined locations on the back face 106. In other embodiments, however, holes may be drilled into the back face 106 at desired locations and the facing anchors 500 may be inserted and secured therein with epoxy, concrete, construction adhesive, combinations thereof, or the like. A series of indentations or grooves 510 along the axial length L of the elongate shaft 502 may help prevent removal of the facing anchor 500 from the facing 102 by providing a stronger bond and/or frictional engagement with the epoxy, concrete, adhesive, etc., within the facing 102. Moreover, in at least one embodiment, the head 504 may be removed from the facing anchor 500 prior to insertion into the hole in order to minimize the required diameter of the hole in the facing 102.

As illustrated in FIG. 5B, the dual-prong stud anchor 500 may be configured to unite the facing 102 to a connection stud 118, and therefore to a soil reinforcing element 110. As with previously disclosed embodiments, a coupling device, such as the nut and bolt assembly 130 or the like, may be inserted through the holes 508 of each prong 506*a,b*, and simultaneously through the hole 124 defined in the tab 122. Once secured to the facing anchor 500, the connection stud 118 may be able to swivel or rotate about axis Y in a horizontal plane (not shown), and move vertically about the nut and bolt assembly 130 for the distance X.

Figure 6A:
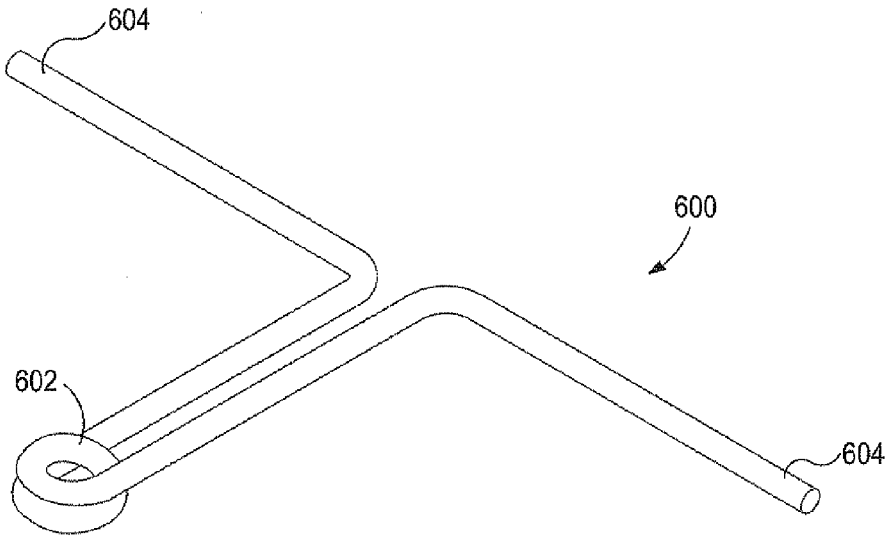
FIG. 6A is a perspective view of an exemplary loop facing anchor, according to one or more aspects of the present disclosure.
Figure 6B:
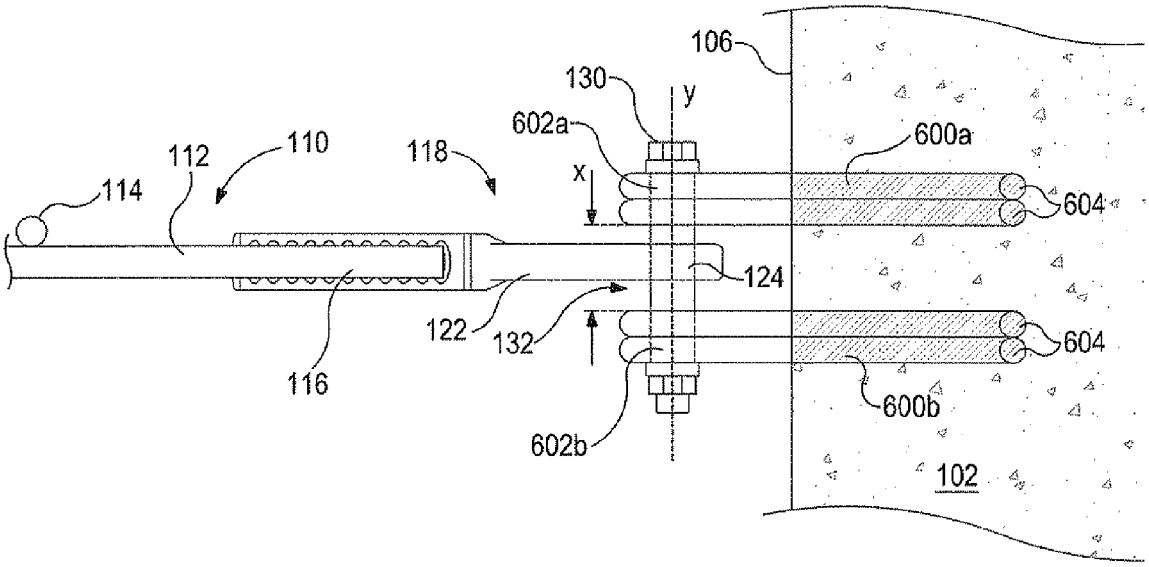
FIG. 6B is a side view of the loop facing anchor of FIG. 6A connected to a connection stud, according to one or more aspects of the present disclosure.

Referring now to FIGS. 6A and 6B, illustrated is another exemplary facing anchor 108, specifically, a loop anchor 600 formed by an unbroken length of continuous wire. As illustrated, the loop anchor 600 may include a horizontally-disposed connection point or loop 602 formed by making a pair of full 360° revolutions of the wire stacked vertically on top of itself. The remaining portion of wire may extend tangentially from the loop 602 and terminate with a pair of lateral extensions 604. In operation, the lateral extensions 604 may be embedded within the facing 102 to provide increased stability and rigidity to the loop anchor 600 connection.

As illustrated in FIG. 6B, a pair of loop anchors 600*a*, 600*b* may be used to secure a soil reinforcing element 110 to the facing 102. While two loop anchors 600*a,b* working in tandem may provide increased rigidity and shear control, the disclosure further contemplates a single loop anchor 600 effectively securing the soil reinforcing element 110 to the facing 102 by itself. At least one additional advantage to using a pair of loop anchors 600*a,b* may be the manipulation of the gap 132 measuring the distance X between vertically-adjacent loop anchors 600*a,b*. For example, in embodiments where a significant amount of settling of the MSE structure is projected, the loop anchors 600*a,b* may be cast into the facing further apart, thereby providing the connector 118 with more distance X to traverse without binding on the facing 102.

As with prior embodiments, a coupling device, such as a nut and bolt assembly 130 or the like, may be inserted through the connection points or loops 602*a* and 602*b* of each loop anchor 600*a,b* and simultaneously through the hole 124 defined in the tab 122. Once secured to the loop anchors 600*a,b*, the connection stud 118 may be able to swivel or rotate about axis Y in a horizontal plane (not shown), and move vertically up and down the nut and bolt assembly 130 for the predetermined distance X.

While the connection stud 118 generally described with reference to FIGS. 2A and 2B may used with the loop anchor 600, the disclosure fully contemplates using any of the connection studs 302 (FIG. 3A), 402 (FIG. 4A), as generally described herein, without departing from the scope of the disclosure. Furthermore, it will be appreciated that any anchor 108, 500, 600, as generally described herein, may be used in combination or in conjunction with any connection stud 118, 302 (loop-type), 402 (dual-prong), as generally described herein, without departing from the disclosure.

The foregoing disclosure and description of the disclosure is illustrative and explanatory thereof. Various changes in the details of the illustrated construction may be made within the scope of the appended claims without departing from the spirit of the disclosure. While the preceding description shows and describes one or more embodiments, it will be understood by those skilled in the art that various changes in form and detail may be made therein without departing from the spirit and scope of the present disclosure. For example, various steps of the described methods may be executed repetitively, combined, further divided, replaced with alternate steps, or removed entirely. In addition, different shapes and sizes of elements may be combined in different configurations to achieve the desired earth retaining structures. Therefore, the claims should be interpreted in a broad manner, consistent with the present disclosure.

I claim:

1. A system for securing a facing to an earthen formation, comprising:

a soil reinforcing element having a pair of longitudinal wires welded to a plurality of spaced transverse wires, wherein the pair of longitudinal wires have lead ends that converge toward one another;

a connection stud having a first end coupled to the lead ends of the longitudinal wires and a second end defining one or more holes centrally-disposed therethrough, the first end comprising an axial length having a series of grooves defined thereon;

a facing anchor having first and second connection points extending from a back face of the facing and vertically-offset from each other a distance X, each connection point defining a horizontally-disposed perforation; and a coupling device configured to be coupled simultaneously to the horizontally-disposed perforation of each connection point and the hole of the connection stud to thereby secure the connection stud to the facing anchor, wherein the soil reinforcing element is capable of swiveling in a horizontal plane and shifting vertically over the distance X.

2. The system of claim 1, wherein the lead ends are welded to the first end.

3. The system of claim 2, wherein the first end further comprises opposing axial channels defined longitudinally along the axial length, the series of grooves being defined within the opposing axial channels.

4. The system of claim 1, wherein the second end is a horizontally-disposed, substantially planar tab.

5. The system of claim 1, wherein the second end is a horizontally-disposed loop.

6. The system of claim 1, wherein the second end comprises a pair of horizontally-disposed prongs vertically-offset from each other, each prong having one or more holes centrally-defined and coaxially aligned therein.

7. The system of claim 1, wherein the connection stud is made from a one-piece forging process.

8. The system of claim 1, wherein the first and second ends are welded to each other.

9. The system of claim 1, wherein the facing anchor is cast into the back face of the facing.

10. The system of claim 1, wherein the coupling device is a nut and bolt assembly.

11. The system of claim 1, wherein the facing anchor further comprises an elongate shaft coupled to the first and second connection points, the elongate shaft having a series of indentations defined along a length of the elongate shaft.

12. The system of claim 1, wherein the facing anchor comprises first and second facing anchors, the first facing anchor comprising the first connection point and the second facing anchor comprising the second connection point.

13. The system of claim 12, wherein each of the first and second facing anchors is formed from an unbroken length of continuous wire that defines the horizontally-disposed perforation and terminates with a pair of lateral extensions that are cast into the facing.

14. A method of securing a facing to a soil reinforcing element, comprising:

welding a pair of converging lead ends of the soil reinforcing element to a first end of a connection stud, the first end comprising an axial length having a series of grooves defined thereon;

inserting a second end of the connection stud into a gap formed between first and second connection points of a facing anchor, the second end and first and second connection points each defining a horizontally-disposed perforation therein, wherein the first and second connection points extend from a back face of the facing and are vertically-offset a distance X; and securing the connection stud against separation from the facing anchor by inserting a coupling device simultaneously into the horizontally-disposed perforations of each of the second end and first and second connection points, wherein the soil reinforcing element is capable of swiveling in a horizontal plane and shifting vertically over the distance X.

15. The method of claim 14, further comprising casting the facing anchor into the back face of the facing.

16. The method of claim 14, further comprising attaching the facing anchor to the back face of the facing.

17. A connection stud for securing a soil reinforcing element to a facing, comprising:

a stem having a first end and a second end, the second end of the stem defining a series of grooves along an axial length of the stem and further being coupled to a pair of converging longitudinal wires from the soil reinforcing element; and a tab coupled to the first end of the stem and defining at least one hole within the tab, wherein the tab is configured to be secured via the at least one hole to a facing anchor extending from a back face of the facing, the soil reinforcing element being capable of swiveling about an axis defined through the at least one hole in a horizontal plane and shifting vertically over a distance X.

18. The connection stud of claim 17, further comprising opposing axial channels defined longitudinally along the axial length of the stem, the series of grooves being defined within the opposing axial channels.

19. The connection stud of claim 17, wherein the tab is a horizontally-disposed, substantially planar tab, and the at least one hole is centrally-defined therein.

20. The connection stud of claim 17, wherein the tab is a horizontally-disposed loop that defines the at least one hole.

21. The connection stud of claim 17, wherein the tab comprises a pair of horizontally-disposed prongs vertically-offset from each other and extending longitudinally from the first end, and the at least one hole is centrally-defined in each prong and coaxially aligned.

22. The connection stud of claim 17, wherein the tab is welded to the first end of the stem.

23. The connection stud of claim 17, wherein the connection stud is made from a one-piece forging process.

* * * * *